US009900701B2

(12) United States Patent
Peng

(10) Patent No.: US 9,900,701 B2
(45) Date of Patent: Feb. 20, 2018

(54) DRIVING APPARATUS, HEAT DISSIPATING APPARATUS AND METHOD FOR SPEAKER VIBRATING DIAPHRAGM COIL, AND MOBILE TERMINAL

(71) Applicant: ZTE CORPORATION, Shenzhen, Guangdong Province (CN)

(72) Inventor: Keren Peng, Shenzhen (CN)

(73) Assignee: ZTE Corporation, Shenzhen, Guangdong Province (CN)

( * ) Notice: Subject to any disclaimer, the term of this patent is extended or adjusted under 35 U.S.C. 154(b) by 0 days.

(21) Appl. No.: 15/103,869

(22) PCT Filed: May 22, 2014

(86) PCT No.: PCT/CN2014/078110
§ 371 (c)(1),
(2) Date: Jun. 12, 2016

(87) PCT Pub. No.: WO2015/089992
PCT Pub. Date: Jun. 25, 2015

(65) Prior Publication Data

US 2016/0323673 A1 Nov. 3, 2016

(30) Foreign Application Priority Data

Dec. 19, 2013 (CN) ..... 2013 1 0703429

(51) Int. Cl.
*H04R 9/02* (2006.01)
*H04R 9/06* (2006.01)

(52) U.S. Cl.
CPC ..... *H04R 9/022* (2013.01); *H04R 9/06* (2013.01); *H04R 9/063* (2013.01); *H04R 2499/11* (2013.01)

(58) Field of Classification Search
CPC ..... H04R 9/022
See application file for complete search history.

(56) References Cited

U.S. PATENT DOCUMENTS

2003/0081808 A1* 5/2003 Kemmerer ..... H04R 9/022 381/397
2009/0267749 A1 10/2009 Sherman
(Continued)

FOREIGN PATENT DOCUMENTS

CN 1222846 A 7/1999
CN 201708915 U 1/2011
(Continued)

*Primary Examiner* — Matthew Eason
(74) *Attorney, Agent, or Firm* — Ling Wu; Stephen Yang; Ling and Yang Intellectual Property

(57) ABSTRACT

A drive apparatus and heat dissipating apparatus for a vibrating diaphragm coil of a speaker, a mobile terminal and heat dissipating method, the heat dissipating apparatus includes: a control unit configured to output an enabling signal to trigger an audible sound drive circuit to work when judging the speaker is in a sounding state, and output an enabling signal to trigger an non-audible sound drive circuit to work if the speaker is in a non-sounding state; the audible sound drive circuit configured to, after being enabled by the control unit, amplify a received audio signal, then drive the vibrating diaphragm coil of the speaker to vibrate; and the non-audible sound drive circuit configured to, after being enabled by the control unit, drive the vibrating diaphragm coil of the speaker to vibrate and control the vibration frequency of the vibrating diaphragm coil to be human ear non-audible ultrasonic or infrasonic frequency.

18 Claims, 7 Drawing Sheets

(56) References Cited

U.S. PATENT DOCUMENTS

| | | | | |
|---|---|---|---|---|
| 2013/0108099 | A1* | 5/2013 | Kemmerer | H04R 9/022 381/397 |
| 2013/0312429 | A1* | 11/2013 | Greuet | F25B 9/14 62/6 |
| 2015/0085441 | A1 | 3/2015 | Reilly et al. | |

FOREIGN PATENT DOCUMENTS

| | | | |
|---|---|---|---|
| CN | 203181218 | U | 9/2013 |
| CN | 103857257 | A | 6/2014 |
| EP | 1053796 | A1 | 11/2000 |
| EP | 1696696 | A1 | 8/2006 |
| JP | 03260554 | A | 11/1991 |
| JP | H07131880 | A | 5/1995 |
| JP | 2003262623 | A | 9/2003 |
| JP | 2013251829 | A | 12/2013 |

* cited by examiner

DRIVING APPARATUS, HEAT DISSIPATING APPARATUS AND METHOD FOR SPEAKER VIBRATING DIAPHRAGM COIL, AND MOBILE TERMINAL

TECHNICAL FIELD

The present document relates the field of mobile communication, in particular to a drive apparatus and heat dissipating apparatus for a vibrating diaphragm coil of a speaker, a mobile terminal comprising the heat dissipating apparatus and a heat dissipating method using the mobile terminal.

BACKGROUND OF THE RELATED ART

Although science and technology of human have already been more developed, intelligent machines are developed at tremendous speed and a trend of fierce competition is presented. However, with the increase of demands of people, speed of control units of smart phone terminal products becomes higher and higher, the products become thinner and thinner, user experience and safety problems caused by heat emission become increasingly obvious, and the problem of heat emission highlights a bottleneck in design and development of mobile phone terminal products and is increasingly concerned by people in the industry.

At present, there are three main design solutions for terminal heat dissipation as follows:

1. When a mobile communication terminal is in a high-power-consumption communication mode, a temperature of the mobile communication terminal is acquired; the temperature is compared with a temperature threshold, and when the temperature is higher than the temperature threshold, the mobile communication terminal is switched from the high-power-consumption communication mode to a low-power-consumption communication mode. By adopting this way, the safety problem caused by excessive heat emission for a reason that the mobile communication terminal works in the high-power-consumption communication mode for a long time can be effectively avoided.

The above-mentioned solution has the following disadvantages: the solution would solve the problem of heat emission caused during communication only, and however, with the popularization of intelligent terminals, purposes of using mobile phones by users have not been limited to making calls and sending short messages at all. Multimedia applications become increasingly popular, and the problem of high heat emission caused while playing games and seeing films cannot be solved through the above-mentioned solution.

2. It is a more popular way in the industry to use auxiliary materials such as heat dissipating and storage materials or the like, e.g., graphite or heat conducting adhesive. For example, a heat dissipating body is provided in a relatively high temperature area of a terminal product and heat in the relatively high temperature area is dissipated through a shell of the mobile terminal; or a heat dissipating body is provided in a relatively high temperature area and a relatively low temperature area of a terminal, and heat in the relatively high temperature area is conducted to the relatively low temperature area.

The above-mentioned has the following disadvantages: due to the limitation of structure or solution design, the use of auxiliary materials cannot fully play performance thereof, merely using auxiliary materials for thermal design cannot effectively dissipate the heat in real time and only take effects of equalizing heat and improving heat dissipating area.

3. Air is enabled to circulate through structural chamber design to achieve the purpose of heat dissipation according to the thermal design principle.

The above-mentioned solution has the following disadvantages: it is feasible to adopt structural design to achieve the purpose of heat dissipation in some terminals with larger volumes, such as large-sized machine cabinets and computer boxes, but the above-mentioned solution is fundamentally useless or is very slightly effective for compact terminals with smaller volumes such as mobile phones. For example, in the case of a micro direct-current brushless heat dissipating fan, the micro heat dissipating fan is generally still larger in size and is mainly used on devices such as desk computers and notebook computers. It cannot be applied to devices such as mobile phones and PDAs at all because they have smaller sizes. In addition, since devices which adopt a convectional heat dissipation way are generally provided with heat dissipating holes, it is usually not realistic to provide heat dissipating holes on small devices such as mobile phones and PDAs, and the effect is not notable.

SUMMARY

The technical problem to be solved by the present document is to provide a drive apparatus for a vibrating diaphragm coil of a speaker, a heat dissipating apparatus, a mobile terminal comprising the heat dissipating apparatus and a heat dissipating method adopting the mobile terminal, so as to achieve the purpose of heat dissipation by controlling the vibration of the vibrating diaphragm of the speaker to reduce the temperature of the complete machine.

In order to solve the technical problem, the present document provides a drive apparatus for a vibrating diaphragm coil of a speaker, comprising:

an audible sound drive circuit configured to, after being enabled, amplify a received audio signal and then drive the vibrating diaphragm coil of the speaker to vibrate; and a non-audible sound drive circuit configured to, after being enabled, drive the vibrating diaphragm coil of the speaker to vibrate and control a vibration frequency of the vibrating diaphragm coil of the speaker to be a human ear non-audible ultrasonic or infrasonic frequency.

Preferably, the non-audible sound drive circuit comprises an infrasonic drive module and/or an ultrasonic drive module;

the infrasonic drive module is configured to, after being enabled, drive the vibrating diaphragm coil of the speaker to vibrate and control the vibration frequency of the vibrating diaphragm coil of the speaker to be a human ear non-audible infrasonic frequency; and the ultrasonic drive module is configured to, after being enabled, drive the vibrating diaphragm coil of the speaker to vibrate and control the vibration frequency of the vibrating diaphragm coil of the speaker to be a human ear non-audible ultrasonic frequency.

Preferably, the infrasonic drive module comprises:

a square wave signal generator configured to perform frequency division processing on an input clock CLK signal, generate a square wave signal at an infrasonic frequency and output the square wave signal to a fundamental wave filter;

the fundamental wave filter configured to filter the input square wave signal, generate a single-frequency sinusoidal wave and output the single-frequency sinusoidal wave to a low-frequency high-gain power amplifier; and the low-frequency high-gain power amplifier configured to, after being enabled, amplify the single-frequency sinusoidal wave and then drive the vibrating diaphragm coil of the speaker to vibrate.

Preferably, the ultrasonic drive module comprises:

a square wave signal generator configured to perform frequency doubling processing on an input clock CLK signal, generate a square wave signal at an ultrasonic frequency and output the square wave signal to a high-frequency filter;

the high-frequency filter configured to filter the input square wave signal, generate a single-frequency sinusoidal wave and output the single-frequency sinusoidal wave to a high-frequency high-gain power amplifier; and the high-frequency high-gain power amplifier configured to, after being enabled, amplify the single-frequency sinusoidal wave and then drive the vibrating diaphragm coil of the speaker to vibrate.

Preferably, the drive apparatus further comprises an auxiliary coil drive circuit, wherein the auxiliary coil drive circuit comprises a magnetic steel coil drive circuit and a magnetic steel coil fixed onto a speaker magnetic steel, wherein, the magnetic steel coil drive circuit is configured to, after being enabled, convert an input digital control signal into a constant current to output to the magnetic steel coil, and change a magnitude and a direction of the constant current through the digital control signal to enhance or weaken an original magnetic steel magnetic field of the vibrating diaphragm coil of the speaker; wherein when the original magnetic steel magnetic field of the vibrating diaphragm coil of the speaker is enhanced, a vibration amplitude of the vibrating diaphragm coil of the speaker becomes larger; and when the original magnetic steel magnetic field of the vibrating diaphragm coil of the speaker is weakened, the vibration amplitude of the vibrating diaphragm coil of the speaker becomes smaller.

In order to solve the technical problem, the present document further provides a heat dissipating apparatus, applied to a mobile terminal, wherein the heat dissipating apparatus comprises a sound outlet, a front sound cavity and a speaker, the speaker comprises a vibrating diaphragm coil, the heat dissipating apparatus further comprises a control unit and the drive apparatus described above and connected with the control unit, the audible sound drive circuit and the non-audible sound drive circuit are respectively connected with the control unit and the vibrating diaphragm coil;

the control unit is configured to judge a working state of the speaker, output an enabling signal to trigger the audible sound drive circuit to work if the speaker is in a sounding state, and output an enabling signal to trigger the non-audible sound drive circuit to work if the speaker is in a non-sounding state;

the audible sound drive circuit is configured to, after being enabled by the control unit, amplify a received audio signal and then drive the vibrating diaphragm coil of the speaker to vibrate;

the non-audible sound drive circuit is configured to, after being enabled by the control unit, drive the vibrating diaphragm coil of the speaker to vibrate and control a vibration frequency of the vibrating diaphragm coil to be a human ear non-audible ultrasonic or infrasonic frequency.

Preferably, the heat dissipating apparatus further comprises a sensor, the sensor is configured to be connected with the control unit, acquire an internal temperature of the mobile terminal and transmit the internal temperature to the control unit; and the control unit is further configured to, before judging the working state of the speaker, firstly judge whether the internal temperature of the mobile terminal reaches a first threshold, turn on a heat dissipating mode if the internal temperature of the mobile terminal reaches the first threshold, and turn off the heat dissipating mode if the internal temperature of the mobile terminal is lower than the first threshold; wherein turning on the heat dissipating mode refers to triggering the audible sound drive circuit to work or triggering the non-audible sound drive circuit to work, and turning off the heat dissipating mode refers to not triggering or stopping the non-audible sound drive circuit from working if the speaker is in the non-sounding state.

Preferably, the sensor is further configured to acquire a heat dissipating state of a complete machine and transmit the heat dissipating state to the control unit;

the control unit is further configured to, when judging that the internal temperature of the mobile terminal reaches the first threshold and is lower than a second threshold, transmit an enabling signal to trigger the infrasonic drive module to work if the speaker is in the non-sounding state; and when the internal temperature of the mobile terminal exceeds the second threshold, judge whether the heat dissipating state of the complete machine acquired by the sensor is normal, and transmit an enabling signal to trigger the ultrasonic drive module to work if the heat dissipating state is normal, wherein the second threshold is larger than the first threshold;

the infrasonic drive module is configured to, after being enabled by the control unit, drive the vibrating diaphragm coil of the speaker to vibrate, and control the vibration frequency of the vibrating diaphragm coil of the speaker to be a human ear non-audible infrasonic frequency; and the ultrasonic drive module is configured to, after being enabled by the control unit, drive the vibrating diaphragm coil of the speaker to vibrate and control the vibration frequency of the vibrating diaphragm coil of the speaker to be a human ear non-audible ultrasonic frequency.

Preferably, the heat dissipating apparatus further comprises an auxiliary coil drive circuit, wherein:

the control unit is further configured to transmit an enabling signal to the auxiliary coil drive circuit to trigger the auxiliary coil drive circuit to work;

the auxiliary coil drive circuit is configured to be connected with the control unit, after being enabled by the control unit, convert an input digital control signal into a constant current to output to a magnetic steel coil, generate a magnetic field superposed on an original magnetic steel magnetic field of the vibrating diaphragm coil of the speaker, and make the magnetic field enhance or weaken the original magnetic steel magnetic field of the vibrating diaphragm coil of the speaker by changing a magnitude and a direction of the constant current; wherein when the original magnetic steel magnetic field of the vibrating diaphragm coil of the speaker is enhanced by the magnetic field, a vibration amplitude of the vibrating diaphragm coil of the speaker becomes larger; and when the original magnetic steel magnetic field of the vibrating diaphragm coil of the speaker is weakened by the magnetic field, the vibration amplitude of the vibrating diaphragm coil of the speaker becomes smaller.

Preferably, the heat dissipating apparatus is further configured to add a heat conducting part which is connected with the front sound cavity, wherein the heat conducting part comprises two portions connecting with each other, one portion is located in the front sound cavity and the other portion is located outside the front sound cavity and is connected to a heat source of the mobile terminal.

Preferably, a heat conductivity coefficient of the vibrating diaphragm of the speaker is smaller than 0.2 W/(m·K).

Preferably, a hollow sound cavity wall is further provided around the speaker and the front sound cavity, a rear sound cavity is formed between the hollow sound cavity wall and the speaker and the front sound cavity, and a portion, outside the front sound cavity, of the heat conducting part passes through the rear sound cavity.

Preferably, an outer surface of the hollow sound cavity wall is coated black.

In order to solve the technical problem, the present document further provides a mobile terminal comprising the heat dissipating apparatus described above.

In order to solve the technical problem, the present document further provides a heat dissipating method, adopting the mobile terminal described above, the heat dissipating method comprises:

judging a working state of the speaker, and if the speaker is in a non-sounding state, controlling the vibration frequency of the vibrating diaphragm coil to be a human ear non-audible ultrasonic or infrasonic frequency.

Preferably, the method further comprises the following steps: if the speaker is in a sounding state, amplifying a received audio signal and then drive the vibrating diaphragm coil to vibrate.

Preferably, before judging the working state of the speaker, the method further comprises: acquiring an internal temperature of the mobile terminal, judging whether the internal temperature of the mobile terminal reaches a first threshold, turning on a heat dissipating mode if the internal temperature of the mobile terminal reaches the first threshold, and turning off the heat dissipating mode if the internal temperature of the mobile terminal is lower than the first threshold, wherein turning on the heat dissipating mode refers to judging the working state of the speaker and executing subsequent steps, and turning off the heat dissipating mode refers to not controlling or stopping controlling the vibrating diaphragm coil to vibrate if the speaker is in the non-sounding state.

Preferably, the method further comprises:

when judging that the internal temperature of the mobile terminal reaches the first threshold and is lower than a second threshold, controlling the vibration frequency of the vibrating diaphragm coil to be a human ear non-audible infrasonic frequency if the speaker is in the non-sounding state; and when the internal temperature of the mobile terminal exceeds the second threshold, judging whether a heat dissipating state of the complete machine acquired by the sensor is normal, and controlling the vibration frequency of the vibrating diaphragm coil to be a human ear non-audible ultrasonic frequency if the heat dissipating state is normal, wherein the second threshold is larger than the first threshold.

Preferably, the method further comprises:

applying a constant current to a magnetic steel coil and changing a magnitude and a direction of the constant current to enhance or weaken an original magnetic steel magnetic field of the vibrating diaphragm coil of the speaker, wherein when the original magnetic steel magnetic field of the vibrating diaphragm coil of the speaker is enhanced, a vibration amplitude of the vibrating diaphragm coil of the speaker becomes larger; and when the original magnetic steel magnetic field of the vibrating diaphragm coil of the speaker is weakened, the vibration amplitude of the vibrating diaphragm coil of the speaker becomes smaller.

Preferably, applying a constant current to a magnetic steel coil and changing a magnitude and a direction of the constant current to enhance or weaken an original magnetic steel magnetic field of the vibrating diaphragm coil of the speaker comprises:

inputting a digital control signal, converting the digital control signal into a constant current to output to the magnetic steel coil and generating a magnetic field superposed on the original magnetic steel magnetic field of the vibrating diaphragm coil of the speaker; and changing the digital control signal to change the magnitude and the direction of the constant current to make the magnetic field enhance or weaken the original magnetic steel magnetic field of the vibrating diaphragm coil of the speaker.

Compared with the prior existing art, according to the drive apparatus, the heat dissipating apparatus for the vibrating diaphragm coil, the heat dissipating apparatus, the mobile terminal comprising the heat dissipating apparatus and the heat dissipating method adopting the mobile terminal provided by the embodiments of the present document, by slightly modifying the structure of the speaker, using the original speaker and the sound outlet in the mobile terminal as the heat dissipating structure, using the sound outlet as the heat dissipating hole, using the vibration of the vibrating diaphragm when the speaker in the sounding state and controlling the vibration frequency of the vibrating diaphragm of the speaker to be a human ear non-audible ultrasonic or infrasonic frequency when the speaker is in the non-sounding state, the embodiments of the present document increase air convection and heat exchange, and reduce the temperature of the complete machine, to achieve the purpose of heat dissipation, and make it possible to solve the problem of heat emission of small-sized devices by using heat convection, thus the product competitiveness is improved, the use safety of the product can be better guaranteed and the user experience is improved.

PREFERRED EMBODIMENTS

The embodiments of the present document will be described below in detail in combination with the drawings. It needs to be stated that the embodiments and the features of the embodiments in the present application can be freely combined under the situation of no conflict.

Embodiment

This embodiment uses a common electrical-acoustic conversion apparatus (speaker) as a heat dissipater and uses vibration of a vibrating diaphragm of the speaker to squeeze hot air in a front sound cavity back and forth, enhance hot air convection, exhaust hot air from a sound outlet as much as possible and increase the convection speed.

Figure 1:
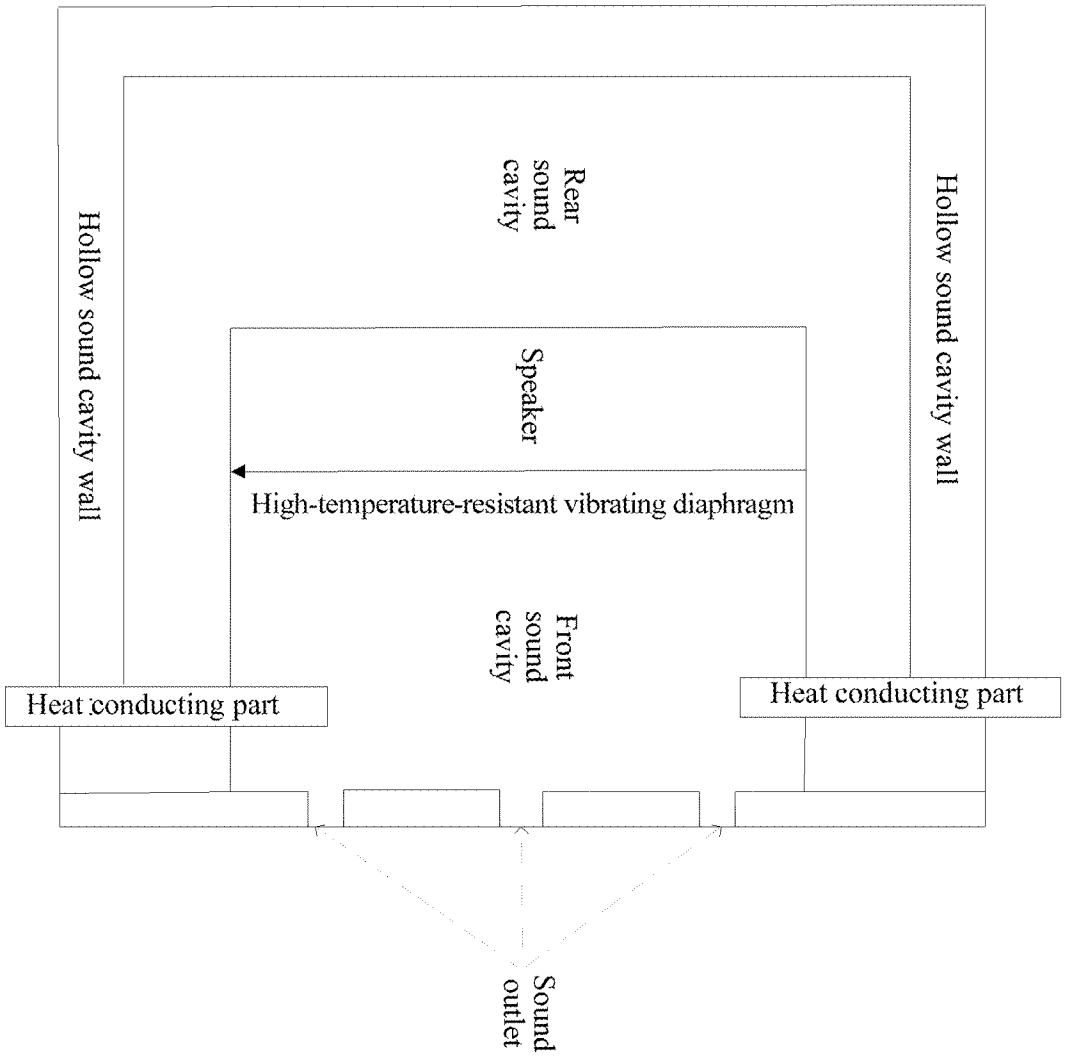
FIG. 1 is a structural diagram of a heat-dissipating-type electrical-acoustic conversion apparatus in the embodiment.

As shown in FIG. 1, this embodiment provides a heat-dissipating-type electrical-acoustic conversion apparatus, which comprises a sound outlet, a front sound cavity, a speaker and a rear sound cavity.

On the basis of the existing electrical-acoustic conversion apparatus, this embodiment adds a heat conducting part which is connected with the front sound cavity, the heat conducting part comprises two portions, one portion is located in the front sound cavity, the other portion is located outside the front sound cavity and is connected to a heat source of the mobile terminal, and the heat conducting part is used for conducting the heat of a heat source in the entire mobile terminal into the front sound cavity;

a hollow sound cavity wall is further provided around the speaker and the front sound cavity, a rear sound cavity is formed between the hollow sound cavity wall and the speaker and the front sound cavity, and a portion, outside the front sound cavity, of the heat conducting part passes through the rear sound cavity. Contact area between the heat conducting part and the rear sound cavity should be as small as possible, so as to transfer heat to the front sound cavity as much as possible and simultaneously reduce heat loss in the rear sound cavity, such that hot air may be dissipated from the sound outlet as quickly as possible.

In addition, although air in the hollow sound cavity wall is used for isolating the heat transfer between the front, rear sound cavity and the complete machine, the air therein is still heated and thus the hollow sound cavity wall may be further provided with a small hole to perform pressure balancing. Meanwhile, by coating the outer surface of the hollow sound cavity wall to be black, for the complete machine, radiated heat will be adsorbed and more heat radiation may be conducted to the front sound cavity and then is dissipated through the sound outlet.

Since it is expected to exhaust the hot air concentrated in the front sound cavity through the sound outlet as quickly as possible, the vibrating diaphragm is made of a material with a small heat conductivity coefficient and capable of resisting 160° C. (for a reason that a CPU chip of a mobile phone terminal or a smart phone cannot work normally if the temperature is higher than 150° C.), and preferably, the heat conductivity coefficient of the vibrating diaphragm of the speaker is smaller than 0.2 W/(m·K);

the sound outlet is used for exhausting the hot air.

Figure 2:
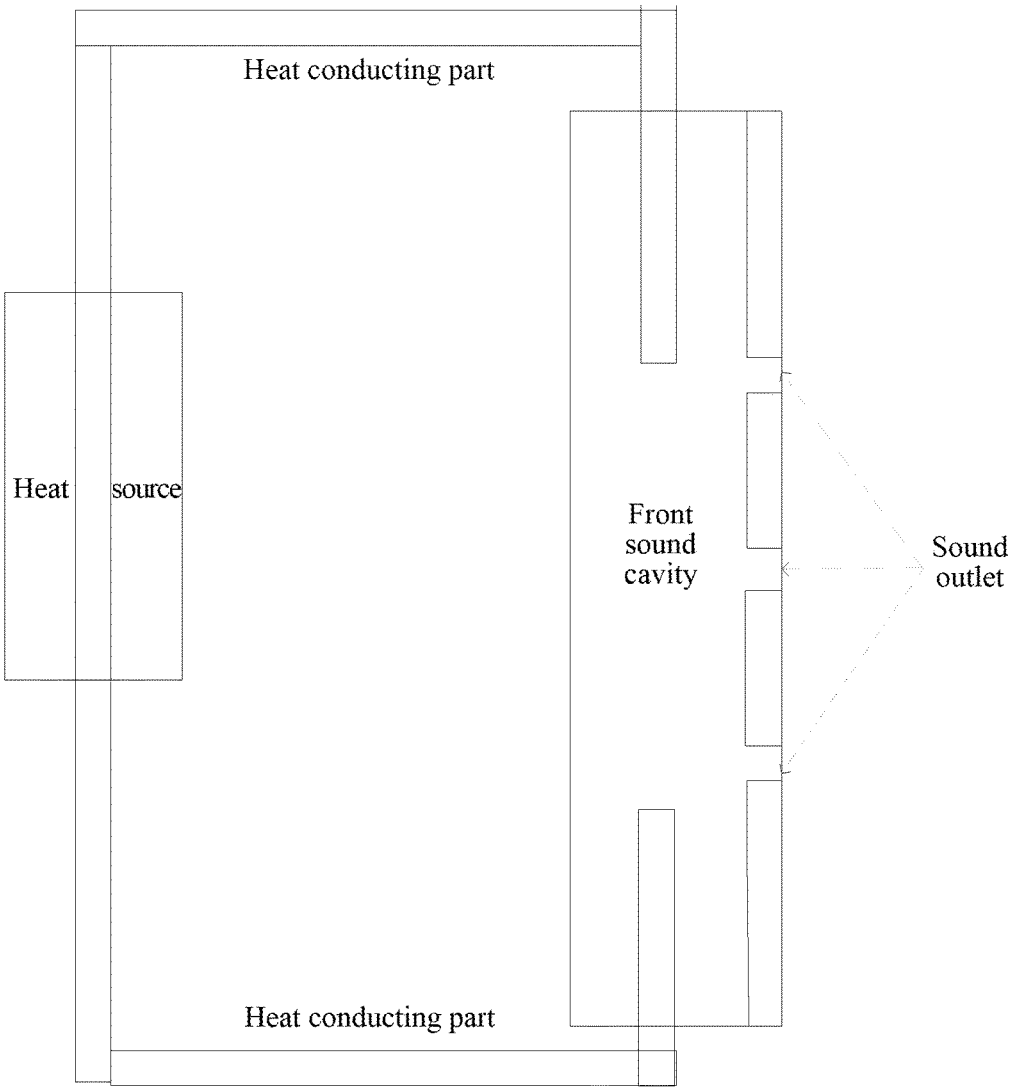
FIG. 2 is a main application scenario diagram of a heat-dissipating-type electrical-acoustic conversion apparatus in FIG. 1 in the embodiment.

FIG. 2 shows a main application scenario of the electrical-acoustic conversion apparatus. The heat of the heat source is quickly conducted into the front sound cavity through the heat conducting part, convection between external air and internal hot air is accelerated through reciprocating movement of the vibrating diaphragm of the speaker and thus the heat source is quickly cooled.

In this embodiment, the most major problem is the vibration problem of the vibrating diaphragm of the speaker. As everyone knows, an electric speaker vibrating diaphragm vibrates while sounding. However, how to enable the vibrating diaphragm to vibrate while not sounding to accelerate convectional heat dissipation becomes the major problem.

Figure 3:
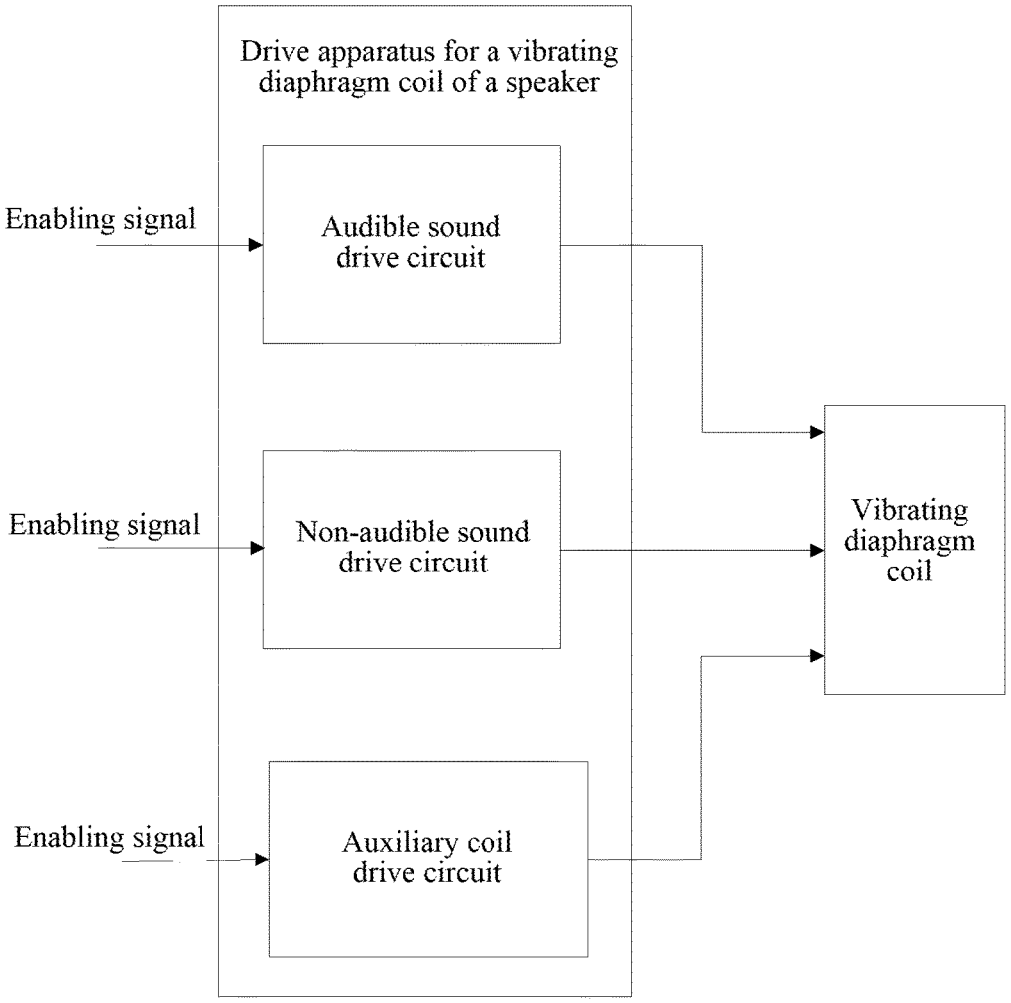
FIG. 3 is a structural diagram of a speaker vibrating diaphragm drive apparatus in the embodiment.

The embodiment provides a drive apparatus for a vibrating diaphragm coil of a speaker. As shown in FIG. 3, the drive apparatus comprises:

an audible sound drive circuit configured to, after being enabled, amplify a received audio signal and then drive the vibrating diaphragm coil of the speaker to vibrate; and output the amplified audio signal to the vibrating diaphragm coil of the speaker and drive the vibrating diaphragm coil to vibrate through the current magnitude and current changing frequency of the audio signal;

a non-audible sound drive circuit configured to, after being enabled, drive the vibrating diaphragm coil of the speaker to vibrate and control the vibration frequency of the vibrating diaphragm coil of the speaker to be a human ear non-audible ultrasonic or infrasonic frequency.

Figure 4:
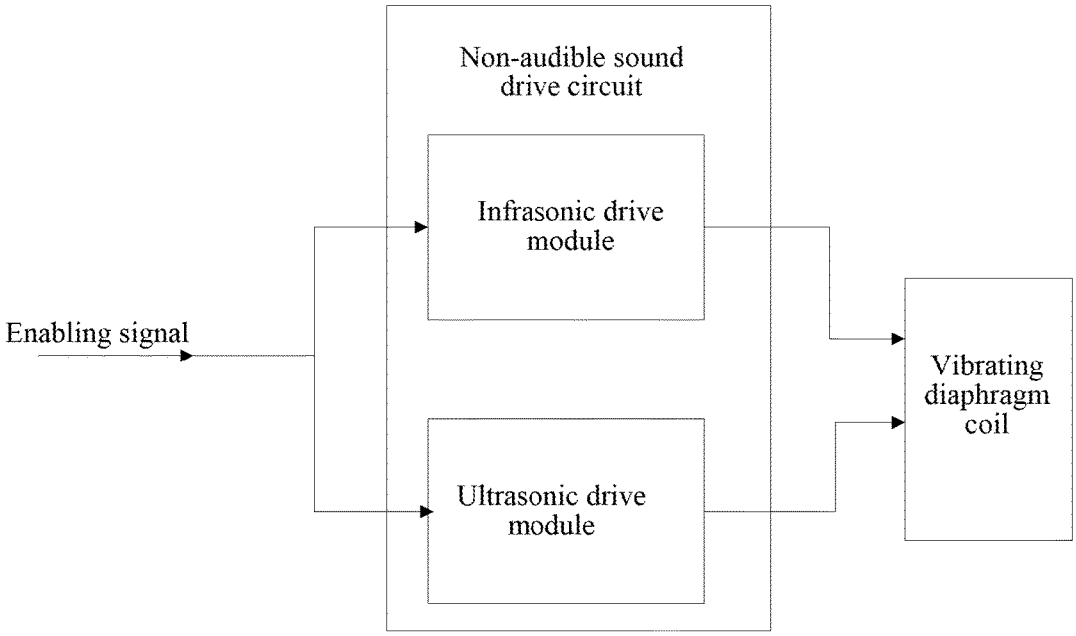
FIG. 4 is a structural diagram of a non-audible sound drive circuit in the embodiment.

Herein, as shown in FIG. 4, the non-audible sound drive circuit comprises an infrasonic drive module and/or an ultrasonic drive module;

the infrasonic drive module is used to, after being enabled, drive the vibrating diaphragm coil of the speaker to vibrate and control the vibration frequency of the vibrating diaphragm coil of the speaker to be a human ear non-audible infrasonic frequency; and the ultrasonic drive module is used to, after being enabled, drive the vibrating diaphragm coil of the speaker to vibrate and control the vibration frequency of the vibrating diaphragm coil of the speaker to be a human ear non-audible ultrasonic frequency.

Figure 5:
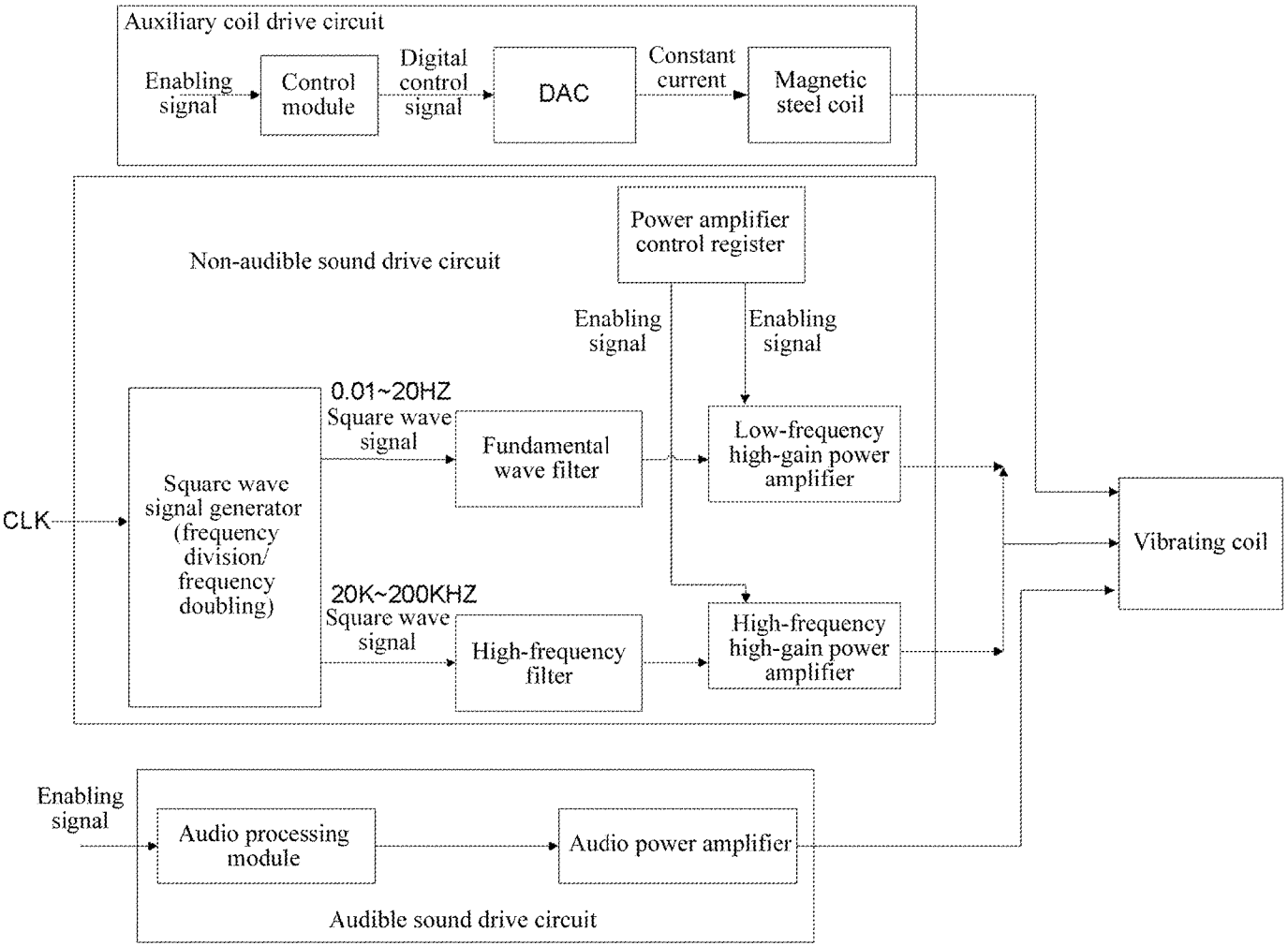
FIG. 5 is a structural diagram of a drive apparatus for a vibrating diaphragm coil of a speaker in one application example.

In one application example, as shown in FIG. 5, a specific embodiment of a drive apparatus for a vibrating diaphragm coil of a speaker is provided, wherein:

the infrasonic drive module comprises:

a square wave signal generator used to perform frequency division processing on an input clock CLK signal, generate a square wave signal at an infrasonic frequency and output the square wave signal to a fundamental wave filter;

the fundamental wave filter used to filter the input square wave signal, generate a single-frequency sinusoidal wave and output the single-frequency sinusoidal wave to a low-frequency high-gain power amplifier; and the low-frequency high-gain power amplifier used to, after being enabled, amplify the single-frequency sinusoidal wave and then drive the vibrating diaphragm coil of the speaker to vibrate.

In other words, the amplified single-frequency sinusoidal wave is output to the vibrating diaphragm coil of the speaker and the vibrating diaphragm coil is enabled to vibrate through the current magnitude and current changing frequency of the single-frequency sinusoidal wave.

The ultrasonic drive module comprises:

a square wave signal generator used to perform frequency doubling processing on an input clock CLK signal, generate a square wave signal at an ultrasonic frequency and output the square wave signal to a high-frequency filter;

the high-frequency filter used to filter the input square wave signal, generate a single-frequency sinusoidal wave and output the single-frequency sinusoidal wave to a high-frequency high-gain power amplifier; and the high-frequency high-gain power amplifier used to, after being enabled, amplify the single-frequency sinusoidal wave and then drive the vibrating diaphragm coil of the speaker to vibrate.

As a preferred embodiment, the drive apparatus further comprises an auxiliary coil drive circuit, the auxiliary coil drive circuit comprises a magnetic steel coil drive circuit and a magnetic steel coil fixed onto a speaker magnetic steel, wherein, the magnetic steel coil drive circuit is used to, after being enabled, convert an input digital control signal into a constant current to output to the magnetic steel coil, generate a magnetic field superposed on an original magnetic steel magnetic field of the vibrating diaphragm coil of the speaker, and make the magnetic field enhance or weaken the original magnetic steel magnetic field of the vibrating diaphragm coil of the speaker by changing a magnitude and a direction of the constant current; when the original magnetic steel magnetic field of the vibrating diaphragm coil of the speaker is enhanced by the magnetic field, a vibration amplitude of the vibrating diaphragm coil of the speaker becomes larger; and when the original magnetic steel magnetic field of the vibrating diaphragm coil of the speaker is weakened by the magnetic field, the vibration amplitude of the vibrating diaphragm coil of the speaker becomes smaller.

The auxiliary coil drive circuit is an auxiliary circuit for the non-audible sound drive circuit and the audible sound drive circuit, the magnitude and direction of the constant current may be changed by changing the digital control signal, and if the direction of the constant current and the direction of the original magnetic steel magnetic field of the vibrating diaphragm coil of the speaker are the same, the original magnetic field will be enhanced, the stress of the vibrating diaphragm coil of the speaker in the magnetic field will be increased and the vibration amplitude is increased; and contrarily, if the direction of the constant current and the direction of the original magnetic steel magnetic field of the vibrating diaphragm coil of the speaker are opposite, part of the original magnetic field will be counteracted, the magnetic field is weakened, the stress of the vibrating diaphragm coil of the speaker will be decreased and the vibration amplitude will be weakened.

As shown in FIG. 5, the auxiliary coil drive circuit specifically comprises:

a control module used to output a digital control signal and control a magnitude and a direction of a converted constant current by changing the digital control signal;

a digital-to-analog converter DAC used to convert the digital control signal into a constant current and output the constant current to a magnetic steel coil after being triggered by the control signal; and the magnetic steel coil used to generate a magnetic field through the magnitude and direction of the constant current, and adjust the vibration amplitude of the vibrating diaphragm coil of the speaker to become larger by enhancing the original magnetic steel magnetic field of the vibrating diaphragm coil of the speaker by the magnetic field, or adjust the vibration amplitude of the vibrating diaphragm coil of the speaker to become smaller by weakening the original magnetic steel magnetic field of the vibrating diaphragm coil of the speaker by the magnetic field.

Figure 6:
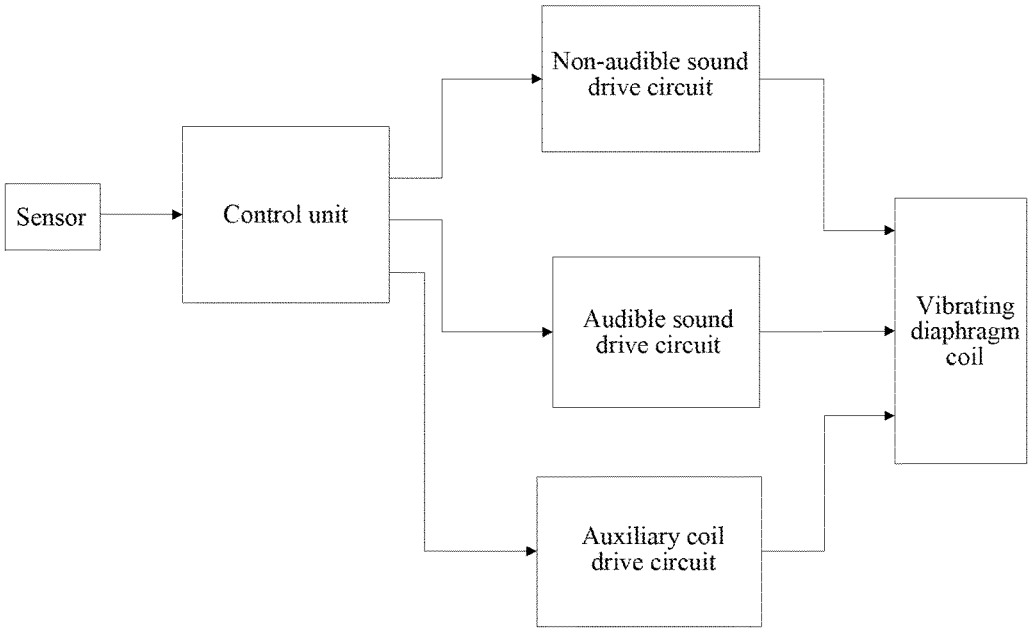
FIG. 6 is a structural diagram of a heat dissipating apparatus in the embodiment.

Therefore, the embodiment provides a heat dissipating apparatus comprising the above-mentioned heat-dissipating-type electrical-acoustic conversion apparatus. As shown in FIG. 6, the heat dissipating apparatus comprises:

a control unit and the above-mentioned audible sound drive circuit and the non-audible sound drive circuit connected with the control unit, wherein the audible sound drive circuit and the non-audible sound drive circuit are respectively connected with the vibrating diaphragm coil.

The control unit is used to judge a working state of the speaker, output an enabling signal to trigger the audible sound drive circuit to work if the speaker is in a sounding state, and output an enabling signal to trigger the non-audible sound drive circuit to work if the speaker is in a non-sounding state;

the audible sound drive circuit is used to, after being enabled by the control unit, amplify a received audio signal and then drive the vibrating diaphragm coil of the speaker to vibrate;

the non-audible sound drive circuit is used to, after being enabled by the control unit, drive the vibrating diaphragm coil of the speaker to vibrate and control the vibration frequency of the vibrating diaphragm coil to be a human ear non-audible ultrasonic or infrasonic frequency.

The vibrating diaphragm coil may vibrate to push air to move back and forth under the drive of the audible sound drive circuit or the non-audible sound drive circuit, so as to exhaust hot air from the sound outlet.

In addition, preferably, the heat dissipating apparatus further comprises a sensor connected with the control unit, wherein:

the sensor is used to acquire an internal temperature of the mobile terminal and transmit the internal temperature to the control unit; and the control unit is further configured to, before judging the working state of the speaker, firstly judge whether the internal temperature of the mobile terminal reaches a first threshold, turn on a heat dissipating mode if the internal temperature of the mobile terminal reaches the first threshold, and turn off the heat dissipating mode if the internal temperature of the mobile terminal is lower than the first threshold, wherein turning on the heat dissipating mode refers to triggering the audible sound drive circuit to work or triggering the non-audible sound drive circuit to work, and turning off the heat dissipating mode refers to not triggering or stopping the non-audible sound drive circuit from working if the speaker is in the non-sounding state.

In addition, the sensor is further used to acquire a heat dissipating state of the complete machine and transmit the heat dissipating state to the control unit;

the control unit is further used to, when judging that the internal temperature of the mobile terminal reaches the first threshold and is smaller lower than a second threshold, transmit an enabling signal to trigger the infrasonic drive module to work if the speaker is in the non-sounding state; and when the internal temperature of the mobile terminal exceeds the second threshold, judge whether the heat dissipating state of the complete machine acquired by the sensor is normal, and transmit an enabling signal to trigger the ultrasonic drive module to work if the heat dissipating state is normal, wherein the second threshold is larger than the first threshold;

the infrasonic drive module is used to, after being enabled by the control unit, drive the vibrating diaphragm coil of the speaker to vibrate, and control the vibration frequency of the vibrating diaphragm coil of the speaker to be a human ear non-audible infrasonic frequency; and the ultrasonic drive module is used to, after being enabled by the control unit, drive the vibrating diaphragm coil of the speaker to vibrate and control the vibration frequency of the vibrating diaphragm coil of the speaker to be a human ear non-audible ultrasonic frequency.

In addition, the embodiment further provides a mobile terminal comprising the heat dissipating apparatus described above.

Figure 7:
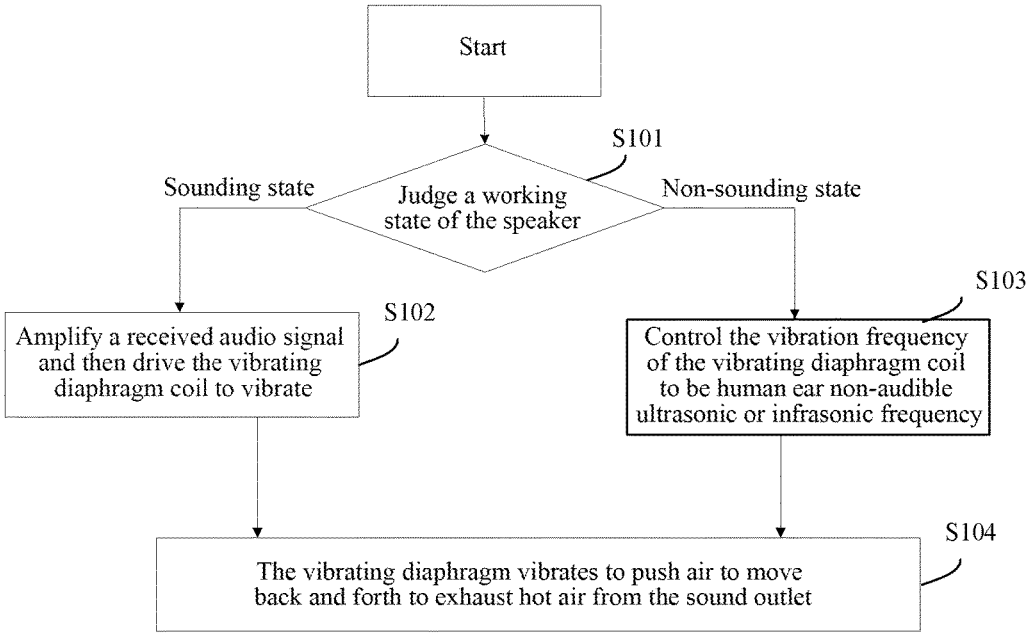
FIG. 7 is a flowchart of a heat dissipating method of a terminal in the embodiment.

As shown in FIG. 7, the embodiment further provides a heat dissipating method of a terminal, adopting the above-mentioned heat dissipating apparatus and comprising the following steps:

In S101, a working state of the speaker is judged; if the speaker is in a sounding state, step S102 is executed; and if the speaker is in a non-sounding state, step S103 is executed.

In S102, a received audio signal is amplified and then the vibrating diaphragm coil is driven to vibrate.

In S103, the vibration frequency of the vibrating diaphragm coil is controlled to be a human ear non-audible ultrasonic or infrasonic frequency;

In S104, the vibrating diaphragm coil vibrates to push air to move back and forth to exhaust hot air from the sound outlet.

Preferably, before step S101, the method further comprises:

before judging the working state of the speaker, it is to acquire an internal temperature of the mobile terminal, judge whether the internal temperature of the mobile terminal reaches a first threshold, and turn on a heat dissipating mode if the internal temperature of the mobile terminal reaches the first threshold, and turn off the heat dissipating mode if the internal temperature of the mobile terminal is lower than the first threshold, wherein turning on the heat dissipating mode refers to judging the working state of the speaker and executing subsequent steps, and turning off the heat dissipating mode refers to not controlling or stopping controlling the vibrating diaphragm coil to vibrate if the speaker is in the non-sounding state.

Herein, when judging that the internal temperature of the mobile terminal reaches the first threshold and is lower than a second threshold, the vibration frequency of the vibrating diaphragm coil is controlled to be a human ear non-audible infrasonic frequency if the speaker is in the non-sounding state; and when the internal temperature of the mobile terminal exceeds the second threshold, whether a heat dissipating state of the complete machine acquired by the sensor is normal is judged, and the vibration frequency of the vibrating diaphragm coil is controlled to be a human ear non-audible ultrasonic frequency if the heat dissipating state is normal, wherein the second threshold is larger than the first threshold.

In steps S102 and S103, preferably, the vibration amplitude of the vibrating diaphragm coil of the speaker may be further controlled by controlling the intensity of the magnetic field, and the method comprises:

applying a constant current to a magnetic steel coil and changing a magnitude and a direction of the constant current to enhance or weaken an original magnetic steel magnetic field of the vibrating diaphragm coil of the speaker, herein when the original magnetic steel magnetic field of the vibrating diaphragm coil of the speaker is enhanced, a vibration amplitude of the vibrating diaphragm coil of the speaker becomes larger; and when the original magnetic steel magnetic field of the vibrating diaphragm coil of the speaker is weakened, the vibration amplitude of the vibrating diaphragm coil of the speaker becomes smaller.

Herein, applying a constant current to a magnetic steel coil and changing a magnitude and a direction of the constant current to enhance or weaken an original magnetic steel magnetic field of the vibrating diaphragm coil of the speaker comprises:

inputting a digital control signal, converting the digital control signal into a constant current to output to the magnetic steel coil and generating a magnetic field superposed on the original magnetic steel magnetic field of the vibrating diaphragm coil of the speaker; and changing the digital control signal to change the magnitude and the direction of the constant current to make the magnetic field enhance or weaken the original magnetic steel magnetic field of the vibrating diaphragm coil of the speaker.

The sensor comprises a 3D sensor, an acceleration sensor and a proximity sensor.

When the heat-dissipating-type speaker works normally, the vibrating diaphragm of the speaker squeezes air and sounds, heat convection is performed due to the vibration of the vibrating diaphragm, and the non-audible sound response circuit is not necessarily turned on. When the speaker does not work, in consideration of the hearing range of human ears, we adopt an ultrasonic or infrasonic wave to drive the vibrating diaphragm to vibrate, i.e., the apparatus needs to work in a non-audible sound mode (harmless infrasonic or ultrasonic waves), and in consideration of the use state of the mobile phone and the heat dissipating way, hence the mobile phone of the user needs to be guaranteed to enter the heat dissipating mode according to the current state of the control unit, the 3D sensor, the acceleration sensor and the proximity sensor of the mobile phone.

Figure 8:
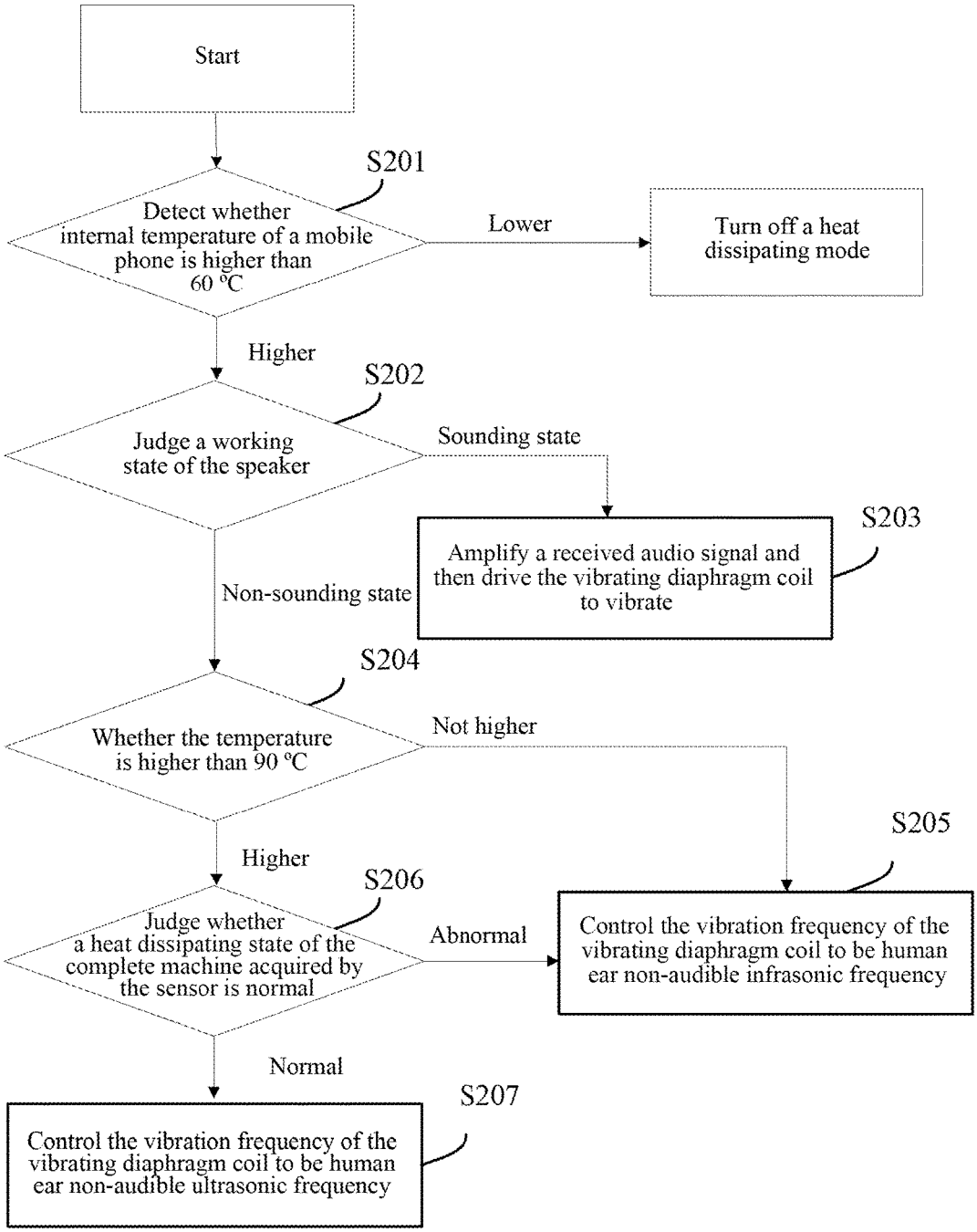
FIG. 8 is a flowchart of a heat dissipating method of a terminal in one application example.

In one application example, as shown in FIG. 8, the heat dissipating way specifically comprises:

In S201, a sensor detects whether an internal temperature of a mobile phone is higher than 60° C.; if the internal temperature is higher than 60° C., step S202 is executed; and otherwise, a heat dissipating mode is turned off;

when detecting that the internal temperature of the mobile phone is lower than 60° C. is detected, the sensor notifies the control unit to turn off the heat dissipating mode and the control unit does not trigger or stops the non-audible sound drive circuit from working.

In S202, it is to judge whether a speaker sounds; if the speaker sounds, step S203 is executed; and otherwise, step S204 is executed.

In S203, a received audio signal is amplified and then the vibrating diaphragm coil is driven to vibrate.

In S204, it is to detect whether the internal temperature of the mobile phone is higher than 90° C.; if the internal temperature is not higher than 90° C., step S205 is executed; and otherwise, step S206 is executed.

In S205, the vibration frequency of the vibrating diaphragm coil is controlled to be a human ear non-audible infrasonic frequency;

In S206, it is to judge whether a heat dissipating state of the complete machine acquired by the sensor is normal; if the heat dissipating state is normal, step S207 is executed; and if the heat dissipating state is not normal, step S205 is returned.

Once the sensor detects that the temperature of the mobile phone is higher than 90° C., the 3D sensor may sense whether the mobile phone is flatly put on a desk and whether the heat dissipating hole is blocked through a 3D sensor, or the proximity sensor may sense whether the holding position of the mobile phone held by the user blocks the heat dissipating hole during conversation via the mobile phone, or may sense a distance between the user and the heat dissipating hole, make a judgment from the angle view of safety and determine whether the heat dissipating state of the sound outlet of the speaker is normal, i.e., whether the sound outlet may dissipate heat, and after the sensor determines that hot air may be output from the sound outlet of the speaker, the non-audible sound response circuit may output ultrasonic frequency and increase the current in the magnetic steel coil to perform quick heat dissipation.

In S207, the vibration frequency of the vibrating diaphragm coil is controlled to be a human ear non-audible ultrasonic frequency.

In the above-mentioned process, when detecting that the internal temperature of the mobile phone is lower than 60° C., the sensor notifies the control unit to turn off the heat dissipating mode, and the control unit does not trigger or stops the non-audible sound drive circuit from working.

As seen from the above-mentioned embodiments, compared with the prior existing art, according to the drive apparatus, the heat dissipating apparatus for the vibrating diaphragm coil, the heat dissipating apparatus, the mobile terminal comprising the heat dissipating apparatus and the heat dissipating method adopting the mobile terminal provided by the embodiments of the present document, by slightly modifying the structure of the speaker, using the original speaker and the sound outlet in the mobile terminal as the heat dissipating structure, using the sound outlet as the heat dissipating hole, using the vibration of the vibrating diaphragm when the speaker in the sounding state and controlling the vibration frequency of the vibrating diaphragm of the speaker to be human ear non-audible ultrasonic or infrasonic frequency when the speaker is in the non-sounding state, in the present document, it is to increase air convection and heat exchange, and reduce the temperature of the complete machine to achieve the purpose of heat dissipation, and make it possible to solve the problem of heat emission of small-sized devices by using heat convection, hence the product competitiveness is improved, the use safety of the product can be better guaranteed and the user experience is improved.

One skilled in the art can understand that all or partial steps in the above-mentioned methods can be completed by relevant hardware instructed by a program, and the program can be stored in a computer readable storage medium such as a read only memory, a magnetic disk or a compact disk. Alternatively, all or partial steps of the above-mentioned embodiments can also be implemented by using one or more integrated circuits. Correspondingly, each module/unit in the above-mentioned embodiments can be implemented by means of hardware, and can also be implemented by means of a software function module. The present document is not limited to the combination of hardware and software in any specific form.

The embodiments are just preferred embodiments of the present document and are not used for limiting the protection range of the present document. The present document may also have other embodiments according to the content of the present document. One skilled in the art can make various corresponding modifications and variations according to the present document without departing from the rule and essence of the present document. However, all these corresponding modifications, equivalent replacements, improvements and the like made within the spirit and principle of the present document shall also be included in the protection range of the present document.

INDUSTRIAL APPLICABILITY

According to the heat dissipating apparatus provided by the embodiments of the present document, by controlling the vibration frequency and amplitude of the vibrating diaphragm and performing reconstruction design on the sound cavity, the electrical-acoustic device is enabled to have electrical-acoustic conversion performance and simultaneously further becomes a heat dissipating device. For the designer, the heat dissipating apparatus not only enables the heat convection transfer way to become possible in the design of the mobile phones, but also enables the structure design and cost control to become simple and feasible. Especially for the users, by solving the problem of heat emission of the mobile phones, not only can the service life of the mobile phones be prolonged, but also the user safety is guaranteed and the user experience is improved.

I claim:

1. A drive apparatus for a vibrating diaphragm coil of a speaker, comprising:

an audible sound drive circuit configured to, after being enabled, amplify a received audio signal and then drive the vibrating diaphragm coil of the speaker to vibrate; and a non-audible sound drive circuit configured to, after being enabled, drive the vibrating diaphragm coil of the speaker to vibrate and control a vibration frequency of the vibrating diaphragm coil of the speaker to be a human ear non-audible ultrasonic or infrasonic frequency; wherein the non-audible sound drive circuit comprises an infrasonic drive module and/or an ultrasonic drive module;

the infrasonic drive module is configured to, after being enabled, drive the vibrating diaphragm coil of the speaker to vibrate and control the vibration frequency of the vibrating diaphragm coil of the speaker to be a human ear non-audible infrasonic frequency; and the ultrasonic drive module is configured to, after being enabled, drive the vibrating diaphragm coil of the speaker to vibrate and control the vibration frequency of the vibrating diaphragm coil of the speaker to be a human ear non-audible ultrasonic frequency;

wherein the infrasonic drive module comprises:

a square wave signal generator configured to perform frequency division processing on an input clock CLK signal, generate a square wave signal at an infrasonic frequency and output the square wave signal to a fundamental wave filter;

the fundamental wave filter configured to filter the input square wave signal, generate a single-frequency sinusoidal wave and output the single-frequency sinusoidal wave to a low-frequency high-gain power amplifier; and the low-frequency high-gain power amplifier configured to, after being enabled, amplify the single-frequency sinusoidal wave and then drive the vibrating diaphragm coil of the speaker to vibrate.

2. The drive apparatus according to claim 1, wherein the ultrasonic drive module comprises:

a square wave signal generator configured to perform frequency doubling processing on an input clock CLK signal, generate a square wave signal at an ultrasonic frequency and output the square wave signal to a high-frequency filter;

the high-frequency filter configured to filter the input square wave signal, generate a single-frequency sinusoidal wave and output the single-frequency sinusoidal wave to a high-frequency high-gain power amplifier; and the high-frequency high-gain power amplifier configured to, after being enabled, amplify the single-frequency sinusoidal wave and then drive the vibrating diaphragm coil of the speaker to vibrate.

3. The drive apparatus according to claim 1, wherein the drive apparatus further comprises an auxiliary coil drive circuit, wherein the auxiliary coil drive circuit comprises a magnetic steel coil drive circuit and a magnetic steel coil fixed onto a speaker magnetic steel, wherein, the magnetic steel coil drive circuit is configured to, after being enabled, convert an input digital control signal into a constant current to output to the magnetic steel coil, and change a magnitude and a direction of the constant current through the digital control signal to enhance or weaken an original magnetic steel magnetic field of the vibrating diaphragm coil of the speaker; wherein when the original magnetic steel magnetic field of the vibrating diaphragm coil of the speaker is enhanced, a vibration amplitude of the vibrating diaphragm coil of the speaker becomes larger; and when the original magnetic steel magnetic field of the vibrating diaphragm coil of the speaker is weakened, the vibration amplitude of the vibrating diaphragm coil of the speaker becomes smaller.

4. A heat dissipating apparatus, applied to a mobile terminal, wherein the heat dissipating apparatus comprises a sound outlet, a front sound cavity and a speaker, the speaker comprises a vibrating diaphragm coil, the heat dissipating apparatus further comprises a control unit and the drive apparatus according to claims 1 and 2 and connected with the control unit, the audible sound drive circuit and the non-audible sound drive circuit are respectively connected with the control unit and the vibrating diaphragm coil;

the control unit is configured to judge a working state of the speaker, output an enabling signal to trigger the audible sound drive circuit to work if the speaker is in a sounding state, and output an enabling signal to trigger the non-audible sound drive circuit to work if the speaker is in a non-sounding state;

the audible sound drive circuit is configured to, after being enabled by the control unit, amplify a received audio signal and then drive the vibrating diaphragm coil of the speaker to vibrate;

the non-audible sound drive circuit is configured to, after being enabled by the control unit, drive the vibrating diaphragm coil of the speaker to vibrate and control a vibration frequency of the vibrating diaphragm coil to be a human ear non-audible ultrasonic or infrasonic frequency.

5. The heat dissipating apparatus according to claim 4, wherein the heat dissipating apparatus further comprises a sensor, the sensor is configured to be connected with the control unit, acquire an internal temperature of the mobile terminal and transmit the internal temperature to the control unit; and the control unit is further configured to, before judging the working state of the speaker, firstly judge whether the internal temperature of the mobile terminal reaches a first threshold, turn on a heat dissipating mode if the internal temperature of the mobile terminal reaches the first threshold, and turn off the heat dissipating mode if the internal temperature of the mobile terminal is lower than the first threshold; wherein turning on the heat dissipating mode refers to triggering the audible sound drive circuit to work or triggering the non-audible sound drive circuit to work, and turning off the heat dissipating mode refers to not triggering or stopping the non-audible sound drive circuit from working if the speaker is in the non-sounding state.

6. The heat dissipating apparatus according to claim 5, wherein, the sensor is further configured to acquire a heat dissipating state of a complete machine and transmit the heat dissipating state to the control unit;

the control unit is further configured to, when judging that the internal temperature of the mobile terminal reaches the first threshold and is lower than a second threshold, transmit an enabling signal to trigger the infrasonic drive module to work if the speaker is in the non-sounding state; and when the internal temperature of the mobile terminal exceeds the second threshold, judge whether the heat dissipating state of the complete machine acquired by the sensor is normal, and transmit an enabling signal to trigger the ultrasonic drive module to work if the heat dissipating state is normal, wherein the second threshold is larger than the first threshold;

the infrasonic drive module is configured to, after being enabled by the control unit, drive the vibrating diaphragm coil of the speaker to vibrate, and control the vibration frequency of the vibrating diaphragm coil of the speaker to be a human ear non-audible infrasonic frequency; and the ultrasonic drive module is configured to, after being enabled by the control unit, drive the vibrating diaphragm coil of the speaker to vibrate and control the vibration frequency of the vibrating diaphragm coil of the speaker to be a human ear non-audible ultrasonic frequency.

7. The heat dissipating apparatus according to claim 4, wherein the heat dissipating apparatus further comprises an auxiliary coil drive circuit, wherein:

the control unit is further configured to transmit an enabling signal to the auxiliary coil drive circuit to trigger the auxiliary coil drive circuit to work;

the auxiliary coil drive circuit is configured to be connected with the control unit, after being enabled by the control unit, convert an input digital control signal into a constant current to output to a magnetic steel coil, generate a magnetic field superposed on an original magnetic steel magnetic field of the vibrating diaphragm coil of the speaker, and make the magnetic field enhance or weaken the original magnetic steel magnetic field of the vibrating diaphragm coil of the speaker by changing a magnitude and a direction of the constant current; wherein when the original magnetic steel magnetic field of the vibrating diaphragm coil of the speaker is enhanced by the magnetic field, a vibration amplitude of the vibrating diaphragm coil of the speaker becomes larger; and when the original magnetic steel magnetic field of the vibrating diaphragm coil of the speaker is weakened by the magnetic field, the vibration amplitude of the vibrating diaphragm coil of the speaker becomes smaller.

8. The heat dissipating apparatus according to claim 4, wherein, the heat dissipating apparatus is further configured to add a heat conducting part which is connected with the front sound cavity, wherein the heat conducting part comprises two portions connecting with each other, one portion is located in the front sound cavity and the other portion is located outside the front sound cavity and is connected to a heat source of the mobile terminal.

9. The heat dissipating apparatus according to claim 8, wherein, a heat conductivity coefficient of the vibrating diaphragm of the speaker is smaller than 0.2 W/(m·K).

10. The heat dissipating apparatus according to claim 8, wherein, a hollow sound cavity wall is further provided around the speaker and the front sound cavity, a rear sound cavity is formed between the hollow sound cavity wall and the speaker and the front sound cavity, and a portion, outside the front sound cavity, of the heat conducting part passes through the rear sound cavity.

11. The heat dissipating apparatus according to claim 10, wherein, an outer surface of the hollow sound cavity wall is coated black.

12. A mobile terminal comprising the heat dissipating apparatus according to claim 4.

13. A heat dissipating method, adopting the mobile terminal according to claim 12, wherein the heat dissipating method comprises:

judging a working state of the speaker, and if the speaker is in a non-sounding state, controlling the vibration frequency of the vibrating diaphragm coil to be a human ear non-audible ultrasonic or infrasonic frequency.

14. The method according to claim 13, further comprising:

if the speaker is in a sounding state, amplifying a received audio signal and then driving the vibrating diaphragm coil to vibrate.

15. The method according to claim 14, wherein, before judging the working state of the speaker, the method further comprises:

acquiring an internal temperature of the mobile terminal, judging whether the internal temperature of the mobile terminal reaches a first threshold, turning on a heat dissipating mode if the internal temperature of the mobile terminal reaches the first threshold, and turning off the heat dissipating mode if the internal temperature of the mobile terminal is lower than the first threshold, wherein turning on the heat dissipating mode refers to judging the working state of the speaker and executing subsequent steps, and turning off the heat dissipating mode refers to not controlling or stopping controlling the vibrating diaphragm coil to vibrate if the speaker is in the non-sounding state.

16. The method according to claim 15, further comprising:

when judging that the internal temperature of the mobile terminal reaches the first threshold and is lower than a second threshold, controlling the vibration frequency of the vibrating diaphragm coil to be a human ear non-audible infrasonic frequency if the speaker is in the non-sounding state; and when the internal temperature of the mobile terminal exceeds the second threshold, judging whether a heat dissipating state of a complete machine acquired by the sensor is normal and controlling the vibration frequency of the vibrating diaphragm coil to be a human ear non-audible ultrasonic frequency if the heat dissipating state is normal, wherein the second threshold is larger than the first threshold.

17. The method according to claim 13, further comprising:

applying a constant current to a magnetic steel coil and changing a magnitude and a direction of the constant current to enhance or weaken an original magnetic steel magnetic field of the vibrating diaphragm coil of the speaker, wherein when the original magnetic steel magnetic field of the vibrating diaphragm coil of the speaker is enhanced, a vibration amplitude of the vibrating diaphragm coil of the speaker becomes larger; and when the original magnetic steel magnetic field of the vibrating diaphragm coil of the speaker is weakened, the vibration amplitude of the vibrating diaphragm coil of the speaker becomes smaller.

18. The method according to claim 17, wherein, applying a constant current to a magnetic steel coil and changing a magnitude and a direction of the constant current to enhance or weaken an original magnetic steel magnetic field of the vibrating diaphragm coil of the speaker comprises:

inputting a digital control signal, converting the digital control signal into a constant current to output to the magnetic steel coil and generating a magnetic field superposed on the original magnetic steel magnetic field of the vibrating diaphragm coil of the speaker; and changing the digital control signal to change the magnitude and the direction of the constant current to make the magnetic field enhance or weaken the original magnetic steel magnetic field of the vibrating diaphragm coil of the speaker.

* * * * *